US007610743B2

(12) United States Patent
Kobayashi et al.

(10) Patent No.: US 7,610,743 B2
(45) Date of Patent: Nov. 3, 2009

(54) CARBON FIBER SPUN YARN AND WOVEN FABRIC THEREOF

(75) Inventors: Tatsuo Kobayashi, Fukushima-Ken (JP); Naohiro Sonobe, Fukushima-Ken (JP)

(73) Assignee: Kureha Corporation, Tokyo (JP)

( * ) Notice: Subject to any disclaimer, the term of this patent is extended or adjusted under 35 U.S.C. 154(b) by 512 days.

(21) Appl. No.: 10/581,254

(22) PCT Filed: Nov. 30, 2004

(86) PCT No.: PCT/JP2004/018103

§ 371 (c)(1), (2), (4) Date: May 31, 2006

(87) PCT Pub. No.: WO2005/054554

PCT Pub. Date: Jun. 16, 2005

(65) Prior Publication Data

US 2008/0307765 A1 Dec. 18, 2008

(30) Foreign Application Priority Data

Dec. 1, 2003 (JP) ..... 2003-401982

(51) Int. Cl.
*D02G 3/02* (2006.01)

(52) U.S. Cl. ..... 57/252

(58) Field of Classification Search ..... 57/252, 57/255; 442/302

See application file for complete search history.

(56) References Cited

U.S. PATENT DOCUMENTS 4,457,345 A * 7/1984 von Blucher et al. ..... 139/420 R
4,913,889 A * 4/1990 Takai et al. ..... 423/447.2
5,313,774 A * 5/1994 Matsumoto et al. ..... 57/255
2007/0145620 A1* 6/2007 Kobayashi et al. ..... 264/29.2
2008/0152906 A1* 6/2008 Kobayashi et al. ..... 428/367

FOREIGN PATENT DOCUMENTS

| | | |
|---|---|---|
| JP | 2003-64539 | 3/2003 |
| JP | 2003-109616 | 4/2003 |
| JP | 2003-221753 | 8/2003 |
| JP | 2003-227053 | 8/2003 |
| JP | 2003-227054 | 8/2003 |
| JP | 2003-239157 | 8/2003 |
| JP | 2003-286631 | 10/2003 |
| WO | 02-42534 | 5/2002 |

* cited by examiner

*Primary Examiner*—Shaun R Hurley
(74) *Attorney, Agent, or Firm*—Wenderoth, Lind & Ponack, L.L.P.

(57) ABSTRACT

A carbon fiber spun yarn, which is a spun yarn of a carbon fiber that has an average (002)-interlayer spacing of 0.340-0.380 nm as measured by X-ray diffraction method, has a specific gravity of 1.55-1.80 as measured by a density gradient tube method, a hydrogen-to carbon atomic ratio (H/C) as measured by elementary analysis of at most 0.1 and contains 3-30 wt. % of carbon fiber having a fiber length of at least 150 mm, wherein the spun yarn has a weight per 1000 m (tex) of 30-150 g, a number of primary twist of 50-400 turns/m and a tensile strength of at least 0.15 N/tex. The carbon fiber spun yarn may be woven to provide a carbon fiber woven fabric suitable as a gas diffuser (electroconductive substrate) of a solid polymer electrolyte fuel cell.

10 Claims, No Drawings

CARBON FIBER SPUN YARN AND WOVEN FABRIC THEREOF

TECHNICAL FIELD

The present invention relates to a carbon fiber spun yarn and a (woven) fabric thereof; more particularly to a carbon fiber spun yarn which is thin and excellent in strength, and a carbon fiber fabric composed thereof and suitable for use as a gas diffuser (electroconductive substrate) of a solid polymer electrolyte fuel cell.

BACKGROUND ART

Carbon fiber produced nowadays include PAN- and rayon-based carbon fiber produced from polyacrylonitrile (PAN) and rayon as starting materials and pitch-based carbon fiber produced from pitches as starting materials. PAN-based carbon fiber is mostly of a high strength-type. On the other hand, pitch-based carbon fiber includes anisotropic carbon fiber and isotropic carbon fiber, of which the anisotropic carbon fiber has a high specific modulus and a high thermal conductivity because of a high crystal perfection and a high orientation of hexagonal net plane in the fiber axis direction, and is used in the fields of sports, leisures and aviation and space technology.

On the other hand, pitch-based isotropic carbon fiber is relatively inexpensive because of inexpensive starting materials and a production process advantageous for mass production, and is widely used in view of properties, such as lightness, chemical resistance, heat resistance, lubricity and electroconductivity.

Carbon fiber is used in various forms, such as filament, sliver, spun yarn, fabric, chops, milled fiber, mats, and prepreg, and its calcination temperature and degree of graphitization may be varied for use thereof. Among these, a carbon fiber woven fabric is used as components of insulating materials, sliding materials and electroconductive materials, and is required to show an affinity with polymeric materials, so that the control of thickness of and voids in the fabric is important.

In recent years, there have been made some proposals of using carbon fiber woven fabric as materials in the field of electronics, such as a gas diffuser in a solid polymer electrolyte fuel cell (e.g., Patent documents 1 and 2 shown below).

Principal functions of a gas diffuser in a solid polymer electrolyte fuel cell are supply of a reaction gas to a catalyst layer and collection of electricity. Accordingly, gas diffusivity and electroconductivity are the most important properties, but in addition thereto, flexibility, high tensile strength, etc, are required (Patent document 1 below).

As for the electroconductivity, a high electroconductivity can be attained through a heat treatment at a high temperature of 2000° C. or higher to provide an increased graphitization degree.

On the other hand, the gas diffusivity is determined by an aperture rate (a porosity ratio) of the fabric, but too coarse a porous material causes a problem in electricity collection due to poor contact with the catalyst layer. In the case of using a carbon fiber fabric as a gas diffuser, it has been disclosed that a spun yarn fabric is preferable than a filament fabric wherein unit filaments are liable to be aligned to provide a high density (Patent document 2 below). In view of supply of gas to the catalyst layer, the reaction gas has to reach the catalyst layer by diffusion through a distance corresponding to the thickness of the gas diffuser, so that too large a thickness of the gas diffuser provides a cause of a lower performance. Accordingly, it is necessary to appropriately control the thickness of the carbon fiber fabric as a gas diffuser.

For the above reasons, it may be concluded that a spun yarn fabric having an appropriate thickness and a thermal history of 2000° C. or higher is preferred as a gas diffuser. Such a spun yarn fabric may be obtained through a process of weaving a flame-resistant fiber or a carbon fiber to provide a fabric and heat-treating the fabric at a temperature of 2000° C. or higher, or a process of weaving a spun yarn heat treated at 2000° C. or higher. Fiber causes heat-shrinkage on heat-treating, so that heat-shrinkage of an insufficiently carbonized fabric is not desirable because the heat-treatment results in strained fiber.

As spun yarn, there are known spun yarn of PAN-based flame-resistant fiber and pitch-based spun yarn. The spun yarn of PAN-based flame-resistant fiber comprises yarn of a relatively small diameter, is strong and can be woven, but it causes a remarkable lowering of strength when heat-treated at 2000° C. and the weaving thereof becomes difficult. Accordingly, an objective fabric cannot be obtained without resorting to a process of weaving such a flame-resistant fiber and heat-treating it at 2000° C. However, the resultant fabric is accompanied with a serious defect of a lower strength because of a strain of the fiber and a lowering in strength due to the heat treatment. For this reason, in order to be used as a gas diffuser, the carbon fiber fabric has to be subjected to supplementary means, such as incorporation of particulate fluorine-containing resin (Patent document 1 below) or backing with a carbon layer containing a fluorine-containing resin (paragraph [0023] of Patent document 2 shown below), but these supplementary means are accompanied with a difficulty that they inevitably lower the electricity collecting function of the gas diffuser. Alternatively, there has been made a proposal of weaving a sliver-form of carbon fiber having a fiber length of at least 25 mm, preferably 50-75 mm to provide a carbon fiber spun yarn of improved strength (Patent document 3 below). However, the thus-obtained carbon fiber spun yarn has a strength of ca. 0.08-0.09 N/tex, which is not yet satisfactory.

On the other hand, the pitch-based isotropic carbon fiber is mostly composed of short fibers, and a spun yarn obtained by further carbonization thereof has been commercialized. However, such a commercialized spun yarn is relatively thick, and a fabric obtained by weaving the spun yarn is caused to have too large a thickness and can only provide a gas diffuser of a lower performance.

Patent document 1: JP-A 2002-352807

Patent document 2: JP-A 2003-288906

Patent document 3: JP-A 53-81735

DISCLOSURE OF INVENTION

In view of the above-mentioned problems of the conventional materials, the present invention aims at providing a carbon fiber spun yarn which has a carbonaceous or graphitic texture, is thin and has a high tensile strength, and a carbon fiber fabric which is excellent in gas permeability, has a high electroconductivity, is excellent in mechanical properties and is suitable as a gas diffuser for a solid polymer electrolyte fuel cell.

In the course of study with the above-mentioned object, the present inventors have found it possible to obtain a carbon fiber spun yarn which is thin and has a high strength and possible to obtain a carbon fiber spun yarn fabric which is excellent in gas permeability, has a high electroconductivity, is excellent in mechanical properties and is suitable as a gas diffuser for a solid polymer electrolyte fuel cell, by weaving the carbon fiber spun yarn, thereby arriving at the present invention.

Thus, the carbon fiber spun yarn according to the present invention is characterized as: a spun yarn of a carbon fiber that has an average (002)-interlayer spacing of 0.340-0.380 nm as measured by X-ray diffraction method, has a specific gravity of 1.55-1.80 as measured by a density gradient tube method, a hydrogen-to carbon atomic ratio (H/C) as measured by elementary analysis of at mostly 0.1 and contains 3-30 wt. % of carbon fiber having a fiber length of at least 150 mm, wherein the spun yarn has a weight per 1000 m (tex) of 30-150 g, a number of primary twist of 50-400 turns/m and a tensile strength of at least 0.15 N/tex.

The reason why the carbon fiber spun yarn of the present invention exhibits a high tensile strength of at least 0.15 N/tex while it is as thin as 30-150 tex is considered attributable to the fact that a sliver of carbon fiber containing an appropriate proportion of long carbon fibers has been subjected to an appropriate degree of spinning.

More specifically, a spun yarn is a long thread bundle of short fibers combined with each other comprising an entanglement of short fibers by applying a twist to the short fibers. The tensile strength thereof is ensured by a force of friction caused by entanglement (contact) of individual single fibers. The more entanglement results in the further increased contact areas between the individual fibers and the more friction leading to an increased strength. Further, the stronger twist results in the stronger press between the individual fibers to result in an increased frictional force and an increased tensile strength of the resultant spun yarn. Further, if the length of used fibers is increased, the number of points of connection between individual fibers can be decreased to result in a spun yarn having an increased strength.

In the present invention, in view of the above points, it is considered that a spun yarn is produced through an appropriate number of twist of 50-400 turns/m and by spinning a thin bundle of relatively long fibers containing an appropriate proportion of 3-30 wt. % of carbon fiber having a length of at least 150 mm which still falls in the category of short fiber but is substantially longer than a conventionally adopted length of, e.g., ca. 25-80 mm (as described in paragraph [0014] of the above-mentioned Patent document 1), thereby having succeeded in providing a carbon fiber spun yarn which is thin and has a high strength as mentioned above.

The carbon fiber spun yarn fabric of the present invention is one obtained by weaving the thin and high-strength carbon fiber spun yarn obtained in the above-described manner and has a shape suitable as a gas diffuser of a solid polymer electrolyte fuel cell.

BEST MODE FOR PRACTICING THE INVENTION

As for the carbon fiber constituting the spun yarn of the present invention, too small an average (002)-interlayer spacing as measured by X-ray diffraction is not preferred because it leads to a high elastic modulus of the carbon fiber and makes difficult the entanglement of individual fibers. On the other hand, too large a spacing means a low carbonization degree and leads to an undesirably low electrical conductivity. The average interlayer spacing is preferably 0.340-0.380 nm, further preferably 0.340-0.375 nm.

The hydrogen-to-carbon atomic ratio (H/C) measured by elementary analysis is known to provide a good measure of degree of carbonization of carbon materials. A larger H/C suggests a lower heat-treatment temperature leading to a lower electroconductivity and a thermal shrinkage on further heat treatment. The H/C ratio is preferably at most 0.1, further preferably at most 0.05, particularly preferably 0.02 or below.

The specific gravity of a carbon fiber is also related with an H/C ratio and is generally in a range of 1.55-1.80, preferably 1.58-1.65, as a value measured according to a density gradient tube method. Too small the value and too large the value result in difficulties similar to those in the cases of too high an H/C ratio and too low an H/C ratio, respectively.

As for the fiber length of carbon fibers constituting the spun yarn, too large a length is liable to cause a difficulty of fiber cutting in a drawframe for producing a spun yarn from slivers by stretching several slivers at a ratio of several times (by passing the slivers between rollers having different rotation speeds) into a single fiber to improve the parallelism of the fibers due to a fiber length longer than the spacing between the rollers. In contrast thereto, too small a fiber length result in a spun yarn having only a lower strength. For this reason, it is preferred that the carbon fiber constituting the spun yarn has such a fiber length that it contains 3-30 wt. %, more preferably 5-20 wt. %, of carbon fiber having a length of at least 150 mm.

Carbon fibers having a length of at most 150 mm are produced by severance or cutting at an appropriate degree of starting carbon fibers in treatment steps using a carding machine and a drawframe and generally have lengths principally in lengths of 50-150 mm, which are contained in an appropriate distribution and in a proportion of 70-97 wt. % to obviate the problem of thickness irregularity of spun yarn resulting in irregularities of thickness and strength of the resultant fabric which are liable to be encountered where only carbon fibers having lengths of 150 mm or large are spun. Carbon fibers having lengths of below 50 mm are contained substantially in a range of at most 20 wt. %.

Individual carbon fibers (filaments) generally have an average diameter in a range of 5-20 μm.

The thickness of a spun yarn obtained by spinning of a carbon fiber sliver is generally expressed in the unit of "tex" which means a weight (g) per 1000 m of the yarn. A thick spun yarn is not preferred because it fails to provide a thin fabric. Too small a thickness fails to provide a fabric having a sufficient strength and results in an undesirably low gas permeability after the weaving. A thickness of 30-150 tex is preferred, further preferably 30-100 tex, particularly preferably 30-80 tex.

The number of twist of a spun yarn greatly affects the strength. Too small a number of twist is not preferred because it results in only a low tensile strength. Too large a number of twist is not preferred either, because it results in breakage of the fiber. The twist number is preferably 50-400 turns/m, further preferably 100-200 turns/m. In the case of doubling two or more spun yarns by a twisting machine, ordinarily a secondary twisting is performed in a reverse direction at a twist number of 60%±5% with respect to the primary twisting, e.g., in the case of two yarns, and in a reverse direction at a twist number of 55%±5% with respect the primary twisting in the case of three yarns.

As a result of the above-mentioned features, the spun yarn of the present invention is provided with a tensile strength of at least 0.15 N/tex, preferably at least 0.2 N/tex.

The spun yarn of the present invention may be produced, e.g., through a process as described below.

As the carbon fiber, it is possible to use any of pitch-based carbon fiber and carbon fibers obtained from polyacrylonitrile and rayon as starting materials. In any case, the carbon fiber constituting the spun yarn of the present invention is allowed to provide a high tensile strength by being carbonized before the spinning thereof, but may be subjected to an additional heat treatment as desired in order to adjust the degree of graphitization thereof. The pitch-based carbon fiber includes carbon fiber obtained from anisotropic pitch and carbon fiber obtained from isotropic pitch, respectively as starting materials. It is preferred to use the carbon fiber obtained from isotropic pitch since the carbon fiber obtained from anisotropic pitch is caused to have a high modulus of elasticity through heat treatment, thus being liable to result in insufficient entanglement of fibers. The heat treatment can be performed either in a state prior to the spinning or after it has been made a spun yarn. The heat treatment temperature is preferably 700-3000° C., further preferably 1500° C.-2500° C.

The length of carbon fiber can vary depending on the process for production thereof. In the case of long fiber, it may be cut before the use thereof, but short fiber having an appropriate length can be used as it is or after controlling the length thereof by a cutting machine.

The above-mentioned carbon fiber may be used to produce a spun yarn through a process as described below.

Carbon fiber may be cut shorter into a short fiber form having lengths of 150 mm or longer and then made into a carbon sliver comprising parallel fibers by means of a carding machine. Then, several carbon fiber slivers are doubled while being drawn or drafted at several times in length into a single thinner carbon fiber sliver of parallel fibers of even better parallelism. The carbon fiber sliver is further drafted and twisted by a spinning frame to obtain a spun yarn.

Pitch-based short fiber may be produced through a centrifugation process wherein a molten pitch is spun through a nozzle under the action of a centrifugal force, a melt-blowing process of blowing a molten pitch together with high-temperature and high-speed air, an eddy current process wherein the high-temperature and high-speed air in the melt-blowing process is made an eddy current flow and the molten pitch is drafter under the action of a whirlpool stream thereof, and an air-sucker process wherein the fiber is drafted by sucking the fiber to an air-sucker nozzle and collected at a downstream of the outlet of the nozzle. A carbon fiber sliver or a carbon fiber mat obtained through any of these processes can be used.

It is preferred that the spun yarn of the present invention is in the form of a single twist yarn in order to provide a thin thread of yarn but can be in the form of a double twist yarn in the thickness range of 30-150 tex.

By weaving the above-mentioned spun yarn, it is possible to obtain a (woven) fabric of spun yarn suitable as a gas diffuser for a solid polymer electrolyte fuel cell. Hereinbelow, a spun yarn (woven) fabric suitable as a gas diffuser for a solid polymer electrolyte fuel cell will be described.

A fabric of too low a FAW (fiber area weight) results in a decreased contact with the catalyst layer to provide only a low electricity-collection performance. On the other hand, a higher FAW provides a higher electricity-collection performance but leads to a lower gas permeability due to fewer voids. Accordingly, the FAW of fabric is preferably at least 50 $g/m^2$ and below 200 $g/m^2$, further preferably at least 100 $g/m^2$ and below 200 $g/m^2$.

As for the thickness of the fabric, a certain level of thickness is required from the viewpoints of gas permeability and water drainability, but too large a thickness requires a considerable time for gas diffusion. Accordingly, the thickness of the fabric is preferably 0.20-0.60 mm, further preferably 0.20-0.40 mm.

In the case of being used as a gas diffuser, the fabric may be in any weave form of plain weave, satin weave, twill weave and basket weave, but plain weave is particularly preferred. In this case, the spun yarn of the present invention may be used as at least either one of warp and weft capable of effectively taking advantage of its strength and in a proportion of at least 30 wt. %, preferably at least 40 wt. %. The volume resistivity of the fabric is preferably 20-1500 μΩ·m, further preferably 50-700 μΩ·m, particularly preferably 50-400 μΩ·m.

EXAMPLES

Hereinbelow, the present invention will be described more specifically based on Examples and Comparative Examples. Physical properties described herein including those in the following Examples are based on measured values according to the following methods.

<Average (002)-Interlayer Spacing According to X-Ray Diffraction Method>

Carbon fiber powder is packed in an aluminum-made sample cell and was irradiated with monochromatic CuKα ray (wavelength λ=0.15418 nm) through a graphite monochromator to obtain an X-ray diffraction pattern. The peak position of the (002) diffraction lines was determined by the center of gravity method (i.e., a method wherein the position of a gravity center of diffraction lines is obtained to determine a peak position as a 2θ-value corresponding to the gravity center) and calibrated by the diffraction peak of (111) diffraction lines of high-purity silicon powder as the standard substance. The $d_{002}$ value was determined according to the Bragg's formula shown below $$d_{002}=\lambda/(2\cdot\sin\theta) \quad \text{(Bragg's formula).}$$

<Specific Gravity According to a Density Gradient Tube Method>

(Preparation of Specific Gravity Liquids)

Prescribed amounts of zinc chloride and 1% hydrochloric acid were weighed in a beaker and mixed with each other. The mixture was transferred to a 50 ml-measuring cylinder and immersed in a low-temperature thermostat water vessel at 20±1.0° C. and was thus adjusted at 20±1.0° C., followed by placing a specific gravity meter to measure a specific gravity thereof. Ten species of specific gravity liquids were prepared by changing relative amounts of the zinc chloride and the 1%-hydrochloric acid.

(Measurement of Specific Gravity of Samples)

Into a 20 ml-measuring cylinder, 2 ml each of the above-prepared 10 species of specific gravity liquids were sequentially added from one of the highest specific gravity and gently while being in contact with the inner tube wall to prepare a density gradient tube. Then, the density gradient tube was placed in a low-temperature thermostat water vessel at 20±1.0° C. and, after lapse of 30 min, ca. 0.1 g of carbon fiber sample having passed through a standard sieve at an opening of 150 μm after being grounded within a mortar and dispersed in a small amount of ethanol was gently added into the density gradient tube and left standing for at least 12 hours. Thereafter, the position of the sample in the density gradient tube was read and, from the position, the specific gravity of the sample was determined with reference to a specific gravity conversion table.

<Hydrogen/Carbon (H/C) Atomic Ratio Measurement>

Weights of hydrogen and carbon in a sample were measured by elementary analysis using a CHN analyzer and were used to determine a number ratio of atoms of hydrogen/carbon.

<Volume Resistivity of Carbon Single Fiber>

Measured according to a test for single fiber in Carbon fiber testing methods (JIS R7601-1986). More specifically, filaments of 4-5 cm in length were taken out of a sample and split into a plurality of single fiber. A single fiber was taken out thereof, placed in a straight line under tension along a center line on a mount according to 6. 6. 1 (2. 3) of the same JIS and fixed thereon at two parts thereof with an electroconductive paint so as to provide a prescribed length. Simultaneously, a copper wire as a lead was fixed with the electroconductive paint together with the sample fiber. The distance along the sample fiber applied on the mount between the two parts of the electroconductive paint was measured at a precision down to 0.1 mm by a length meter to provide a test length. Further the diameter of the sample fiber was read by a measuring microscope. Then, the resistance of the sample fiber was measured by a resistance meter to determine a volume resistivity according to the following formula:

$$Sf=(\pi\cdot D^2\cdot Rf)/(4\cdot L),$$

wherein Sf: volume resistivity (Ω·m), Rf: resistance of the sample fiber (Ω), L: length of the sample fiber (m), and D: diameter of the sample fiber (m).

<Strength of Spun Yarn>

A tensile load (N) at breakage of a sample spun yarn was measured by using a tensile tester ("Tensilon Universal Tester Model 1310", made by K.K. Orientec) under the conditions of a spun yarn length between chucks of 300 mm and a tensile speed of 200 mm/min, and was divided by the value of tex of the spun yarn to obtain a spun yarn strength (N/tex).

<Measurement of Fabric Thickness>

Measured according to Method 1 of Carbon fiber cloth testing methods (JCFS 003-1982). More specifically, 5 test pieces each measuring 100 mm×100 mm were subjected to measurement with a straight progress-type paper micrometer ("Model PPM-25", made by K.K. Mitsutoyo), whereby the spindle thereof was gently rotated so that the measurement surface thereof contacted in parallel with the sample surface until the ratchet caused three times of sound to record a reading of the meter. An average of the measured values was taken down to two digits below the decimal point.

<Volume Resistivity of Carbon Fiber Fabric>

A fabric sample of ca. 0.5 m in length×ca. 0.5 m in width and a pressing plate of a thickness meter (a straight progress-type paper micrometer ("Model PPM-25", made by K.K. Mitsutoyo) were held so that they were parallel to each other, and the thickness was measured at two points for each of 4 sides shifted by ca. 0.10 m toward the center (totally 8 points for one sample) to obtain an average thickness value. Then, one longitudinal test piece (measuring 0.22 m in the longitudinal direction and 0.20 m in the transverse direction) and one transverse test piece (measuring 0.22 m in the transverse direction and 0.20 m in the longitudinal direction) were cut out from the sample. Each of the cut samples was fixed between electrodes of copper plate terminals on rigid plates and was pressed at 4.9 MPa, and the resistance was measured for each of the longitudinal and transverse test pieces. The volume resistivity of the carbon fiber fabric was calculated according to the following formula:

$$T=A\cdot B/C,$$

wherein T: volume resistivity (Ω·m), A: resistance of the test piece (Ω), B: sectional area of the test piece ($m^2$)(=thickness of the test piece (m)×size of one side of the test piece (0.20 m)) and C: spacing between the electrodes at the time of measuring the resistance of the test piece (0.20 m).

Example 1

Isotropic pitch-based carbon fiber (having an average monofilament diameter=ca. 14.5 μm) obtained by heat-treated at 1000° C. for 1 hour in a nitrogen atmosphere was cut into a fiber length of 200 mm by using a cutter. The fibers were drawn evenly by a carding machine to obtain a sliver of 10 g/m. Then, one sliver was drafted at 5.1 times by a first drawframe to obtain a sliver of 1.96 g/m. Then, two of the slivers were put together and drafter at 4.6 times to provide a single sliver by a second drawframe, and two of the resultant slivers were put together and drafted at 2.0 times obtain a single sliver by a third drawframe. The sliver was drafted at 12 times and spun at a number of Z (left) twist of 130 turns/m by a spinning frame to obtain a spun yarn of 70 tex. Then, two threads of the spun yarn were put together and doubled at a number of S (right) twist of 78 turns/m by a twister to obtain a spun yarn of 140 tex.

The spun yarn was subjected to plain weaving to obtain a fabric having an FAW of 150 g/$m^2$ and a thickness of 0.30 mm.

Some physical properties and characteristic values of the thus-obtained spun yarn and fabric are inclusively shown in Table 1 described later together with those of Examples and Comparative Examples described below.

Example 2

A similar operation as in Example 1 was performed except that the spinning was performed at a number of Z (left) twist of 180 turns/m by the same spinning frame as in Example 1 instead of the number of Z (left) twist of 130 turns/m and the doubling by the twister was omitted, whereby a spun yarn of 70 tex was obtained.

The spun yarn was subjected to plain weaving to obtain a fabric of FAW=70 g/$m^2$ and a thickness of 0.15 mm.

Example 3

A similar operation as in Example 2 was performed except that the isotropic pitch-based carbon fiber obtained by heat-treatment for 1 hour at 1000° C. in a nitrogen atmosphere was cut by a cutter into a fiber length of 180 mm instead of 200 mm, whereby a spun yarn of 70 tex was obtained.

By using the spun yarn, a plain weave-fabric of FAW=70 g/$m^2$ and a thickness of 0.15 mm was obtained.

Example 4

A similar operation as in Example 2 was performed except that the sliver in Example 2 was spun at a number of Z (left) twist of 100 turns/m instead of 180 turns/m, whereby a spun yarn of 70 tex was obtained.

The spun yarn was subjected to plain weaving to obtain a fabric of FAW=70 g/$m^2$ and a thickness of 0.15 mm.

Example 5

A similar operation as in Example 2 was performed except that the isotropic pitch-based carbon fiber obtained by heat-treatment for 1 hour at 1500° C. in a nitrogen atmosphere was used instead of the isotropic pitch-based carbon fiber obtained by heat-treatment for 1 hour at 1000° C. in a nitrogen atmosphere used in Example 2, whereby a spun yarn of 70 tex was obtained.

The spun yarn was subjected to plain weaving to obtain a fabric of FAW=70 g/m$^2$ and a thickness of 0.15 mm.

Example 6

A similar operation as in Example 2 was performed except that the isotropic pitch-based carbon fiber obtained by heat-treatment for 1 hour at 2000° C. in a nitrogen atmosphere was used instead of the isotropic pitch-based carbon fiber obtained by heat-treatment for 1 hour at 1000° C. in a nitrogen atmosphere used in Example 2, whereby a spun yarn of 70 tex was obtained.

The spun yarn was subjected to plain weaving to obtain a fabric of FAW=70 g/m$^2$ and a thickness of 0.15 mm.

Example 7

PAN-based carbon fiber (having an average monofilament diameter=ca. 7-8 μm) obtained by heat-treated at 2000° C. for 1 hour in a nitrogen atmosphere was cut into a fiber length of 200 mm by using a cutter. The fibers were drawn evenly by a carding machine to obtain a sliver of 10 g/m. Then, one sliver was drafted at 5.1 times by a first drawframe to obtain a sliver of 1.96 g/m. Then, two of the slivers were put together and drafter at 3.2 times to provide a single sliver by a second drawframe, and two of the resultant slivers were put together and drafted at 2.0 times obtain a single sliver by a third drawframe. The sliver was drafted at 12 times and spun at a number of twist of 180 turns/m by a spinning frame to obtain a spun yarn of 100 tex.

The spun yarn was subjected to plain weaving to obtain a fabric having an FAW of 100 g/m$^2$ and a thickness of 0.18 mm.

Example 8

A spun yarn of 70 tex was obtained in the same manner as in Example 2 and then heat-treated at 2000° C. for 1 hour in a nitrogen atmosphere.

The spun yarn was subjected to plain weaving to obtain a fabric of FAW=70 g/m$^2$ and a thickness of 0.15 mm.

Comparative Example 1

A similar operation as in Example 2 was performed except that the isotropic pitch-based carbon fiber obtained by heat-treatment at 1000° C. for 1 hour in a nitrogen atmosphere was cut by a cutter into a fiber length of 140 mm instead of the 200 mm in Example 2, whereby a spun yarn of 70 tex was obtained.

The spun yarn was subjected to plain weaving whereas the yarn was frequently severed so that it was difficult to obtain a fabric.

Comparative Example 2

A similar operation as in Example 7 was performed except that the isotropic pitch-based carbon fiber obtained by heat-treatment at 2000° C. for 1 hour in a nitrogen atmosphere was cut by a cutter into a fiber length of 140 mm instead of the 200 mm in Example 7, whereby a spun yarn of 100 tex was obtained.

The spun yarn was subjected to plain weaving whereas the yarn was frequently severed so that it was difficult to obtain a fabric.

Comparative Example 3

A similar operation as in Example 1 was performed except that the sliver of 10 g/m was spun by the spinning frame while being drafted at 10.5 times instead of the 12 times in Example 1, and two threads of the spun yarn were put together and doubled by the twister at a number of S (right) twist of 110 turns/m instead of 78 turns/m, whereby a spun yarn of 160 tex was obtained.

The spun yarn was subjected to plain weaving to obtain a fabric of FAW=230 g/m$^2$ and a thickness of 0.46 mm.

Comparative Example 4

A similar operation as in Example 2 was performed except that the isotropic pitch-based carbon fiber obtained by heat-treatment for 1 hour at 800° C. in a nitrogen atmosphere was used instead of the isotropic pitch-based carbon fiber obtained by heat-treatment for 1 hour at 1000° C. in a nitrogen atmosphere used in Example 2, whereby a spun yarn of 70 tex was obtained.

The spun yarn was subjected to plain weaving to obtain a fabric of FAW=70 g/m$^2$ and a thickness of 0.15 mm.

The results of the above Examples and Comparative Examples are inclusively shown Table 1 described hereafter.

TABLE 1

| | Carbon fiber | | | | | | Spun yarn | | | | Fabric | | |
|---|---|---|---|---|---|---|---|---|---|---|---|---|---|
| Example | Starting material | Calcination temp. (° C.) | Inter-layer spacing (nm) | Specific gravity | Volume resistivity (μΩ · m) | H/C | Content of fiber of ≧150 mm (wt. %) | Diameter of spun yarn (tex) | Number of primary twist (turn/m) | Strength (N/tex) | FAW (g/m$^2$) | Thick-ness (mm) | Volume resistivity (μΩ · m) |
| 1 | pitch | 1000 | 0.375 | 1.63 | 150 | 0.05 | 10 | 140 | 130 | 0.21 | 150 | 0.30 | 850 |
| 2 | pitch | 1000 | 0.375 | 1.63 | 150 | 0.05 | 10 | 70 | 180 | 0.29 | 70 | 0.15 | 900 |
| 3 | pitch | 1000 | 0.375 | 1.63 | 150 | 0.05 | 7 | 70 | 180 | 0.23 | 70 | 0.15 | 900 |
| 4 | pitch | 1000 | 0.375 | 1.63 | 150 | 0.05 | 10 | 70 | 100 | 0.21 | 70 | 0.15 | 900 |
| 5 | pitch | 1500 | 0.365 | 1.61 | 100 | 0.02 | 10 | 70 | 180 | 0.29 | 70 | 0.15 | 600 |
| 6 | pitch | 2000 | 0.359 | 1.60 | 50 | 0 | 10 | 70 | 180 | 0.29 | 70 | 0.15 | 240 |
| 7 | acryl | 2000 | 0.353 | 1.78 | 20 | 0 | 5 | 100 | 180 | 0.20 | 100 | 0.18 | 100 |
| 8 | pitch | 1000 (after spinning: 2000° C.) | 0.359 | 1.60 | 50 | 0 | 10 | 70 | 180 | 0.29 | 70 | 0.15 | 250 |
| Comp. 1 | pitch | 1000 | 0.375 | 1.63 | 150 | 0.05 | 0 | 70 | 180 | 0.13 | — | — | — |
| Comp. 2 | acryl | 2000 | 0.353 | 1.78 | 20 | 0 | 0 | 100 | 180 | 0.13 | — | — | — |

TABLE 1-continued

| | Carbon fiber | | | | | | Spun yarn | | | | Fabric | | |
|---|---|---|---|---|---|---|---|---|---|---|---|---|---|
| Example | Starting material | Calcination temp. (° C.) | Inter-layer spacing (nm) | Specific gravity | Volume resistivity (μΩ · m) | H/C | Content of fiber of ≧150 mm (wt. %) | Diameter of spun yarn (tex) | Number of primary twist (turn/m) | Strength (N/tex) | FAW ($g/m^2$) | Thick-ness (mm) | Volume resistivity (μΩ · m) |
| Comp. 3 | pitch | 1000 | 0.375 | 1.63 | 150 | 0.05 | 10 | 160 | 180 | 0.25 | 230 | 0.46 | 880 |
| Comp. 4 | pitch | 800 | 0.400 | 1.66 | 350 | 0.12 | 10 | 70 | 180 | 0.22 | 70 | 0.15 | 2100 |

As is understood from the results shown in Table 1, according to the present invention, a carbon fiber sliver containing an appropriate proportion of carbon fiber having a longer fiber length than ever and processed by spinning at an appropriate number of twist to obtain a carbon fiber spun yarn which is thin and has a high strength, and by weaving the spun yarn, it is possible to obtain a carbon fiber fabric suitable as a gas diffuser (electroconductive substrate) for a solid polymer electrolyte fuel cell.

The invention claimed is:

1. A carbon fiber spun yarn, which is a spun yarn of a carbon fiber that has an average (002)-interlayer spacing of 0.340-0.380 nm as measured by X-ray diffraction method, has a specific gravity of 1.55-1.80 as measured by a density gradient tube method, a hydrogen-to carbon atomic ratio (H/C) as measured by elementary analysis of at most 0.1 and contains 3-30 wt. % of carbon fiber having a fiber length of at least 150 mm, wherein the spun yarn has a weight per 1000 m (tex) of 30-150 g, a number of primary twist of 50-400 turns/m and a tensile strength of at least 0.15 N/tex and where the carbon fiber has an average diameter of 5-20 μm.

2. A carbon fiber spun yarn according to claim 1, wherein the carbon fiber is an isotropic pitch-based carbon fiber.

3. A carbon fiber spun yarn according to claim 1, wherein the carbon fiber is a polyacrylonitrile-based carbon fiber or a rayon-based carbon fiber.

4. A carbon fiber spun yarn according to claim 1, containing 70-97 wt. % of carbon fiber having a fiber length of 50-150 mm.

5. A carbon fiber spun yarn according to claim 1, which is in a single-twist state.

6. A carbon fiber woven fabric, comprising at least 30 wt. % thereof of a carbon fiber spun yarn according to claim 1.

7. A carbon fiber woven fabric according to claim 6, having a fiber area weight (FAW) of at least 50 $g/m^2$ and below 200 $g/m^2$, and a thickness of 0.20-0.60 mm.

8. A carbon fiber woven fabric according to claim 6, having a volume resistivity of 20-1500 μΩ·m.

9. A carbon fiber woven fabric according to claim 6, which is in a state of plain weave.

10. A gas diffuser for a solid polymer electrolyte fuel cell, comprising a carbon fiber woven fabric according to claim 6.

* * * * *